US011457701B2

(12) United States Patent
Casas

(10) Patent No.: US 11,457,701 B2
(45) Date of Patent: Oct. 4, 2022

(54) WRIST WATCH STRAP MANUFACTURING METHOD

(71) Applicant: MB "TVARIOS INOVACIJOS", Vilnius (LT)

(72) Inventor: Algimantas Casas, Vilnius (LT)

(73) Assignee: MB "TVARIOS INOVACIJOS", Vilnius (LT)

( * ) Notice: Subject to any disclaimer, the term of this patent is extended or adjusted under 35 U.S.C. 154(b) by 198 days.

(21) Appl. No.: 16/954,838

(22) PCT Filed: Dec. 11, 2018

(86) PCT No.: PCT/IB2018/059861
§ 371 (c)(1),
(2) Date: Jun. 17, 2020

(87) PCT Pub. No.: WO2019/123102
PCT Pub. Date: Jun. 27, 2019

(65) Prior Publication Data

US 2021/0085039 A1 Mar. 25, 2021

(30) Foreign Application Priority Data

Dec. 18, 2017 (LT) ..... 2017 541

(51) Int. Cl.
*A44C 5/00* (2006.01)
*A44C 5/14* (2006.01)

(52) U.S. Cl.
CPC ..... *A44C 5/0053* (2013.01); *A44C 5/14* (2013.01)

(58) Field of Classification Search
CPC ..... A44C 5/0053; A44C 5/14; A44C 27/001
See application file for complete search history.

(56) References Cited

U.S. PATENT DOCUMENTS

| | | | | |
|---|---|---|---|---|
| 3,962,013 | A * | 6/1976 | Mashida | B29C 67/00 156/304.6 |
| 4,110,139 | A * | 8/1978 | Mashida | B29D 29/00 264/293 |
| 4,183,986 | A * | 1/1980 | Blaetterlein | B29C 59/026 224/178 |
| 4,849,145 | A * | 7/1989 | Hirsch | A44C 5/2076 264/328.8 |
| 5,046,197 | A * | 9/1991 | Chernuchin | A41F 9/002 2/322 |
| 9,796,140 | B2 * | 10/2017 | Page | B29C 64/112 |
| 2014/0227517 | A1 | 8/2014 | De La Lama Gomez | |
| 2017/0065038 | A1 | 3/2017 | Griffin, II et al. | |
| 2017/0224064 | A1 * | 8/2017 | Hamada | D03D 3/06 |
| 2017/0250554 | A1 * | 8/2017 | Tajima | H02J 7/007 |

FOREIGN PATENT DOCUMENTS

| | | |
|---|---|---|
| CN | 201131372 | 10/2008 |
| JP | 2004121591 | 4/2004 |

OTHER PUBLICATIONS

International Search Report for PCT/IB2018/059861 dated Jul. 4, 2018 (two pages).

* cited by examiner

*Primary Examiner* — Brian D Nash
(74) *Attorney, Agent, or Firm* — Tutunjian & Bitetto, P.C.

(57) ABSTRACT

The invention relates to watch straps made of felt material. The method includes cutting out the strap from the felt material with a density of up to 0.5 g/cm$^3$; forming the ends of the strap to be fastened to the watch body by adjusting the shape of the strap ends to the shape of a specific watch body and/or to strap fastening elements; impregnating the shaped ends of the strap with polymeric glue, preferably with liquid cyanoacrylate; precisely adjusting the fully dried and processed strap ends to the watch body or strap fastening elements; drilling the transversal apertures in the strap ends for inserting the watch pins to fasten the strap to the watch body. The watch strap thus obtained is eco-friendly, recyclable, non-allergenic and can be securely fastened to the watch body.

6 Claims, No Drawings

WRIST WATCH STRAP MANUFACTURING METHOD

FIELD OF THE INVENTION

The invention relates to wrist watch straps which are made of environmentally friendly, non-allergenic, non-polluting and easy recyclable materials. More particularly, the invention relates to watch straps made of merino wool felt material.

BACKGROUND OF THE INVENTION

Currently, the market for watches is dominated by straps made of a single material, such as plastic, leather, metal or silicone or combination thereof. All these watch straps have their own advantages, but they also have drawbacks. For example, plastic straps or straps made of silicone are lightweight, durable, easy to fabricate, easy to maintain, clean, wash, recycle, etc. However, straps made of plastic or silicone are not air-permeable, which means that the material does not allow wrist skin to breathe as well as does not absorb moisture, therefore often causes a variety of skin allergies or uncomfortable feeling.

Leather watch straps are more suitable for a human body and they are more comfortable to wear, unfortunately, they have poor air permeability and get stained quickly. Moreover, leather cannot be cleaned with water or by using any chemicals which may disintegrate or damage the leather. In addition, various animal protection organizations encourage not to use any product manufactured from animal leather.

The metal straps, which are very prevalent among wristwatch users, not only have the above-mentioned disadvantages, but are also expensive, heavy, do not absorb moisture, provoke skin sweating on a hot day and are very good cold conductors in the winter, in addition, metal is not an environmentally friendly material and it is difficult to recycle without huge effort. In order to at least partially reduce the number of flaws for metal straps, compound straps, made of metal and covered with leather are being manufactured, this is described in the Chinese patent application CN201131372.

SUMMARY OF THE INVENTION

The purpose of this invention is to eliminate the aforementioned disadvantages by manufacturing a watch strap which is lightweight, appealing to the eye, easy to wear, eco-friendly, easy to maintain and recycle, also, a strap which is not causing allergies to human skin and which can be applied to all of the wristwatches including smart watches.

According to the current invention, felted material is being used for production, preferably Merino wool felt with a density up to 0.5 g/cm3, which can be obtained by both wet felting and dry needle felting. This is a 100% mechanical process without any chemicals usage that could cause allergies to human skin. As a result, an organic non-woven material is obtained, it can be up to 1 cm thick, preferably about 3-5 mm. When thickening, felting and compacting Merino wool fiber, a felt is obtained, which has high tensile strength, easy to form, permeable to air and moisture, non-allergenic, lightweight and can be dyed to give it any colour.

The problem arises when such felt watch straps need to be fastened to the clock body. Usually the individual sides of a single watch strap are attached to the opposite sides of the watch body through two pins of adjustable lengths, which are then inserted into the channel, formed by bending the strap end which is supposed to be fastened, and sewing it or otherwise attaching it to the inner surface of the strap. The issue with the felt watch strap is that it is not resistant to long lasting attrition which happens when wearing a watch for a long time. The attrition happens in the area where the strap is fastened to the watch body. After wearing the watch for a long time, the strap end attached to a watch body might simply be torn to pieces.

Japan Patent Application No. JP2004121591 describes a watch strap made of multilayer glued felt material. Unlike the usual two-part watch straps, this strap is made as a uniform element with an expansion in the middle where there is a cut-out for fixing the watch body. This type of watch strap is reliable as there is no risk of the watch strap tearing apart after wearing it for a longer period of time. However, such strap is complicated to manufacture by the fact that it is necessary to form an individual slot in its strap for each watch, which depends on the shape of the watch body.

It was decided to upgrade the conventional two-piece strap design so that the felt strap could be reliably and firmly fastened to any watch body through a regular strap fastening elements. For this purpose, the felt material's porosity and ability to absorb the impregnated material was used. It has been observed that after impregnating the ends of the watch strap to be fastened to the watch body with polymeric glue and allowing them to dry, i.e. to polymerize, the ends of the strap remains elastic and flexible, but at the same time quite strong and hard to form passages for watch pins.

It has also been observed that by making the ends of the watch strap in a specific shape adapted to the shape of an individual body of a particular watch, or in a shape adapted to a specific strap fastening elements, which is typical for smart watches, and then impregnating the shaped ends of the strap with polymeric glue, straps keep this shape immutable throughout its wearing time. This gives you a contiguous solid felt strap, having hardened ends that has been reinforced by polymeric glue.

DETAILED DESCRIPTION OF THE INVENTION

The sequence of production of the watch strap from the felt material according to the current invention is as follows: first, the parts of the strap of both necessary shapes are cut from the felt material by means of a press, a laser or any other known method. If the strap is designed for a particular watch body with an individual shape, then the ends of the watch straps are formed, giving them an individual shape adapted to the clock body or strap fastening to the watch body elements. For example, the ends of the strap can be shaped so that they embrace the elements of the strap fastening, visually hiding them within the ends of the straps.

After the ends of the strap are reshaped for attaching them to the watch body, they are impregnated with polymeric glue. This is done either by simply immersing both ends of the strap through 0.5-1.0 cm into liquid polymer glue, or by lubricating them with polymeric glue, or by vacuum incorporation of polymer glues into a felt material. After testing it was determined that liquid cyanoacrylate is most appropriate for this purpose. Cyanoacrylate is characterized by its colourlessness and its short polymerization time, also by the fact that during the polymerization it creates long, strong chains that evenly cover the impregnated surface giving it a monolithic quality. However, at the same time, the cyanoacrylate polymer remains robust and flexible enough in order to be resistant to tearing and bending.

When the ends of the watch strap are shaped and reinforced in this way, they can be further machined to the final shape, and then the transversal passages are drilled in the straps in order to fasten them to the watch body. The watch strap produced in this way is characterized by the fact that despite being made of felt material, it remains light, flexible and soft throughout its length, and its ends, impregnated with cyanoacrylate, acquire the strength inherent to straps made of plastic or metal. Moreover, since it is made of Merino wool felt, it is environmentally friendly, easy to recycle, non-allergenic.

Though the invention is described by an example of the method of manufacturing a watch strap, it can be adapted to manufacturing any felt product, such as trousers belts, bracelets, etc., i.e. it can be applied where a solid and reliable bonding of the felt material with another material or other element is required, where there is a tensile force applied between the two materials.

The invention claimed is:

1. A method for making a two-part wrist watch strap of felt material, comprising cutting out separate parts of the watch strap from prepared felt material, wherein primary shaping the ends of the watch strap, cut out from the felt material, designed for fastening to the watch body, by adapting the shape of the watch strap ends to the shape of the specific watch body and/or to strap fastening to the watch body elements;

comprising the following steps:

a) impregnating the watch strap ends, designed for fastening to the watch body, with polymeric glue;

b) after drying the polymeric glue, secondary mechanical treating of polymerized ends, finishing the polymerized watch strap ends to precisely match the watch body and/or fastening elements of the watch body;

c) drilling the transversal passages for fixing the strap to the watch body elements.

2. The method according to claim 1, characterized by using the felt material produced from Merino wool felt with a density up to 0.5 g/cm$^3$.

3. The method according to claim 1, characterized by using the felt material having thickness up to 1 cm, preferably from 3 to 5 mm.

4. The method according to claim 1, characterized by using liquid cyano acrylate to impregnate the felt strap ends to be fastened to the watch body.

5. The method according to claim 4, characterized by impregnating the watch strap ends, to be fastened to the watch body, with liquid cyano acrylate using immersion, lubrication or vacuumization methods.

6. The method according to claim 1, wherein the length of the watch strap ends impregnated with cyanoacrylate is in the range from 0.5 to 1.0 cm.

* * * * *